US007585372B2

(12) United States Patent
Jokela et al.

(10) Patent No.: US 7,585,372 B2
(45) Date of Patent: Sep. 8, 2009

(54) METHOD AND APPARATUS FOR GENERATING GAS PULSES

(75) Inventors: Pauli Jokela, Lahti (FI); Kimmo Savolainen, Lahti (FI)

(73) Assignee: Nirafon Oy, Lahti (FI)

( * ) Notice: Subject to any disclaimer, the term of this patent is extended or adjusted under 35 U.S.C. 154(b) by 606 days.

(21) Appl. No.: 11/089,789

(22) Filed: Mar. 23, 2005

(65) Prior Publication Data

US 2005/0217702 A1 Oct. 6, 2005

(30) Foreign Application Priority Data

Apr. 2, 2004 (FI) ..... 20040486

(51) Int. Cl.
*B08B 3/12* (2006.01)
*G10K 9/00* (2006.01)

(52) U.S. Cl. ..... 134/10; 134/1; 134/19; 122/379; 122/396; 116/137 R; 116/137 A

(58) Field of Classification Search ..... 134/1, 134/19, 22.1, 184, 186; 181/116, 117; 116/137 R, 116/137 A; 122/379, 396; 165/95
See application file for complete search history.

(56) References Cited

U.S. PATENT DOCUMENTS

| | | | | |
|---|---|---|---|---|
| 2,635,813 | A * | 4/1953 | Schlenz | 236/1 A |
| 3,592,287 | A * | 7/1971 | Mollere | 181/118 |
| 2005/0109231 | A1 | 5/2005 | Bussing | |
| 2005/0112516 | A1 | 5/2005 | Aarnio et al. | |
| 2005/0125933 | A1 | 6/2005 | Hochstein, Jr. et al. | |
| 2005/0126595 | A1 | 6/2005 | Flatness et al. | |
| 2005/0130084 | A1 | 6/2005 | Aarnio et al. | |
| 2005/0199743 | A1 | 9/2005 | Hochstein, Jr. et al. | |

FOREIGN PATENT DOCUMENTS

| | | |
|---|---|---|
| FI | 20000044 | 8/2000 |
| FI | 109098 | 5/2002 |
| WO | 98/53926 | 12/1998 |
| WO | WO-98/53926 | * 12/1998 |
| WO | 01/78912 | 10/2001 |

* cited by examiner

*Primary Examiner*—Michael Barr
*Assistant Examiner*—Saeed T Chaudhry
(74) *Attorney, Agent, or Firm*—Smith-Hill & Bedell, P.C.

(57) ABSTRACT

Method and apparatus of producing gas pressure pulses in a dust-deposit cleaning apparatus. The apparatus comprises a combustion chamber and an amplifying horn. According to the method a combustible gas and oxygen is fed into the combustion chamber, which has a generally elongated shape, the gas mixture is ignited for generating a pressure pulse, and the pressure pulse is released from the chamber and conducted to the amplifying horn. The gas mixture is ignited to generate an initial explosion which causes a pressure wave, which is reflected from the inner walls of the chamber end to form a collision zone, in which the initial explosion is at least partially transformed into a detonation. The combustion front is reflected from the gas inlet end and compressed at the other end of the chamber and released to the amplifying horn. By means of the invention, sound levels of about 165-170 dB can be produced at low fuel consumption.

17 Claims, 1 Drawing Sheet

METHOD AND APPARATUS FOR GENERATING GAS PULSES

Figure 1:
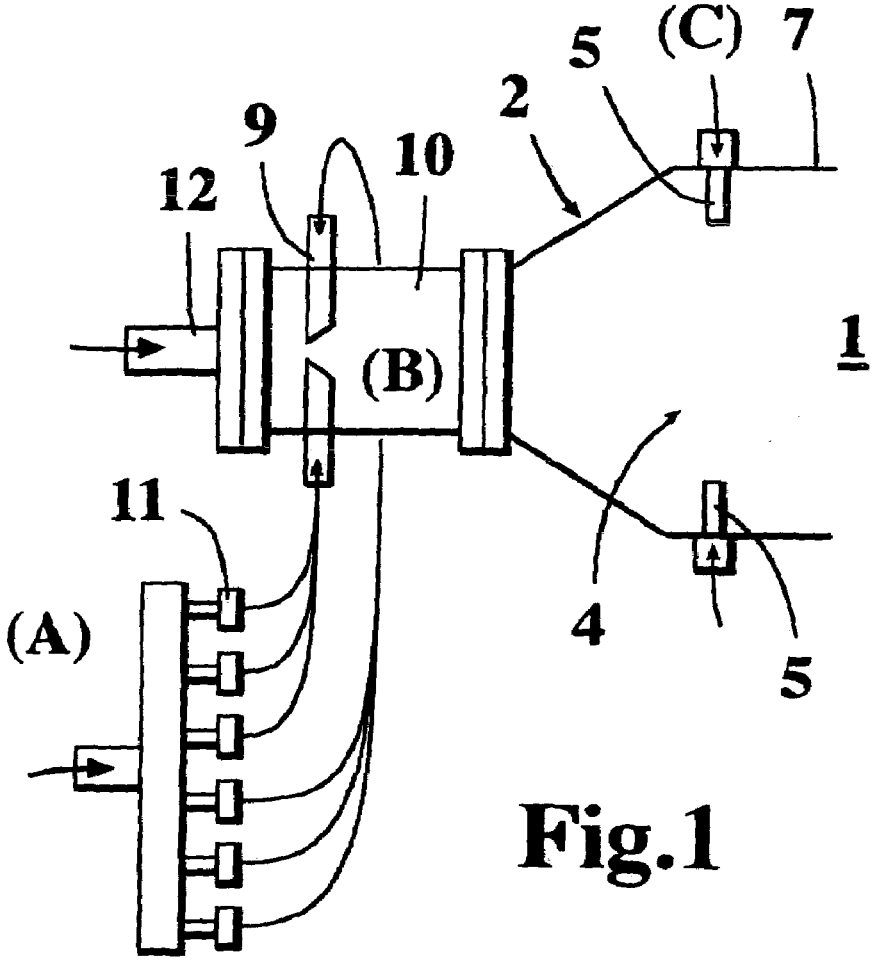

This application claims priority of Finnish Patent Application No. 20040486 filed Apr. 2, 2004.

The present invention relates to a method for generating gas phase pulses in a dust-deposit cleaning device comprising a combination of a combustion chamber and an amplifying horn.

According to a method of the present kind, a combustible gas and oxygen is fed into a combustion chamber, which has a generally elongated shape with two opposite ends, to form a combustible gas mixture, the gas mixture is ignited for generating a pressure pulse, and the pressure pulse is released from the chamber and conducted to the amplifying horn for creating an amplified pulse.

The invention also concerns an apparatus according to the preamble of claim 5 and a method for using such apparatus according to the preamble claim 9.

Both the method and the apparatus are particularly useful for generating amplified gas phase pulses (sounds), which can be utilized for cleaning particle deposits in industrial process equipment and in power plants.

In power plants, cement handling etc, where tiny particles are generated or formed as the main product of the process or as by-products, a general problem is that particles are deposited on the surfaces of the processing equipment. In power plants, such particle deposits increase pressure losses and dramatically reduce heat transfer between gas and cooling or heating medium, such as water, steam or preheated combustion air.

Conventionally, cleaning of soot- or particle-laden surfaces of processing equipment, has been carried out by methods known as "soot-blowing" or "soot-hammering", comprising the steps of blowing the equipment with air or steam or by subjecting the surface to steel balls hammering. The latter technique, where steel balls were dropped vertically from above and collected at the bottom of the equipment, is difficult to carry out and it causes some destruction of the internal surfaces. Steam blowing has the disadvantage that it sometimes hardens the ash and causes erosion on the tube surfaces.

More recently, new technology has been developed in which ash- or soot-removal is effected by the use of sound having a frequency in the range from 20 to 250 Hz and a sound pressure of up to 160 dB. Conventional sound generators employed in such methods use pressure air or a rotating siren to make the sound, which is amplified in an expanded horn and directed towards the surfaces where cleaning is needed. The sound pressure, as given in decibels, is not necessarily the best indication for the cleaning power of the device. Sound is normally sinus-waved, and the lower the frequency the lower the rate of change from low pressure to high pressure. At high frequency, on the other hand, the total energy follows the relation: amplitude×frequency~energy.

As known, when frequency increases, the amplitude will be reduced at constant energy.

To overcome the above problem, an explosion pulse cleaner has been designed where fuel and air are ignited in an explosion chamber and the explosion pulse is amplified in a normal horn device. With this arrangement it is possible to get a high-speed pressure swing from positive to negative. To mention an example of known technology, reference can be made to the gas pulse cleaner described in WO 01/78912 A1. In the known cleaner, the explosion is generated by igniting a gas mixture comprising hydrogen and oxygen, which is made by electrolysis for every explosion separately.

In our earlier PCT Application (WO 02/04861 A1) we have disclosed a method of using sound pulses for reducing NOx emissions and for improving combustion efficiency in a power plant. In this technology, a gas-pulse device somewhat similar to the engine of the German V1 rocket is used. Later on, we have constructed different kinds of gas pulse cleaning devices, which are provided with separate combustion chamber ignition spark plugs and gas and air valves. Typically, these kinds of devices will give an effective pulse every 8th second with a sound pressure of 165 to 170 dB measured at a distance of 4 meters. These devices have explosion chambers with a volume of about 25 liters and they burn propane at a rate of 2 g/explosion in the presence of air. The explosion chambers are cylindrical, with a diameter amounting to ⅓ of the length.

A Ukrainian company has introduced an explosion cleaning device, where an electric spark is ignited with a high energy electrical spark in a mixture of air and methane, and it is claimed that a true detonation—instead of an explosion—would be obtained within a 1.5 m long tube. With a detonation of this kind, the local detonation front pressure may be as high as 100 bar, whereas the pressure in a normal gas explosion wave front is only 5 to 7 bar.

U.S. Pat. No. 5,015,171 discloses a continuous "Tunable pulse burner", producing a 300 Hz sound wave which is used to improve the combustion in a power plant, but where one pulse burns about 5 mg of gas.

Based on the literature, it appears that in order to convert an explosion into a detonation with a gas-air mixture, there are at least two minimum conditions that need to be met:

a) the energy of igniting spark or laser beam must be about 1000 J or more, and
b) the detonation length in tube must be at least 1500 mm, when the diameter of the detonation tube is about 100 mm.

The transition of normal deflagmation to detonation can also be aided by the formation of some roughness or a spiral structure, known as the "Schelkin Spiral", on the inner wall of the combustion chamber. Mr Schelkin studied this phenomenon already in 1946.

It is an aim of the present invention to provide a gas pulse device for cleaning particle deposits, which device will have a reduced consumption of fuel while still efficiently providing a sound pressure on the order of at least 160 dB at a distance of 4 meters, and a gas local pressure at—at least some point—of 50 to 100 bar or more. Further, it is an object of the present invention to provide a gas pulse device and a method for operating it, which will allow for an increased number of pressure strokes.

The present invention is based on the idea of generating a total or partial detonation or highly improved normal combustion in a combustion chamber having reduced volume. In particular, we have found that it is advantageous to feed a combustible gas and oxygen containing gas into a combustion chamber having an elongated shape with two opposite, generally tapered ends, one of which is closed or closable and the other of which is open to allow for gas eruption. In such a chamber, the gas mixture can be ignited close to the essentially closed end of the combustion chamber. By locating the ignition zone close to one end of the chamber it is possible to create, by the pressure wave reflected from the inner walls of the chamber end, a compression zone, in which the initial explosion within the gas mixture can be transformed into a detonation. The detonation is then allowed to erupt through the remote end of the elongated combustion chamber while creating a sound and pressure wave, which propagates through the gas pulse device and can be directed towards the object subjected to cleaning. Furthermore, it has been found that it is particularly preferable to create the explosion within the ignition zone by means of symmetrically placed ignition means.

Considerable advantages are obtained by the present invention. Thus, the new combustion chamber is small and it makes it possible to achieve a sound level of about 165-170 dB at a fuel consumption that is less than 1/10, even less than 1/20, of what has earlier be achieved experimentally.

Next, the invention will be examined in more closely with the aid of the following detailed description and with reference to the attached drawings.

Figure 2:
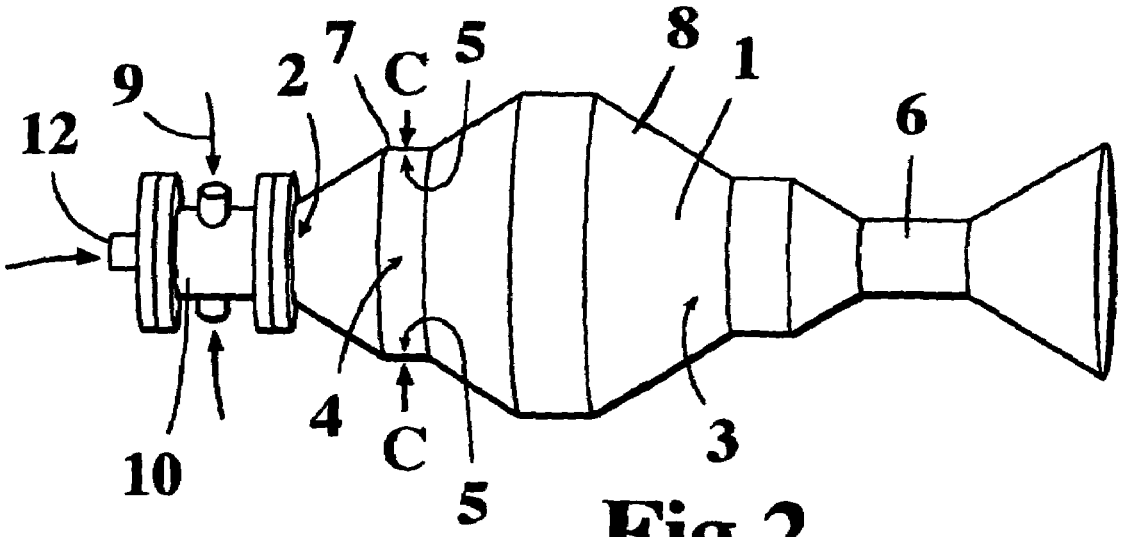

FIG. 1 shows schematically the configuration of the mixing section of a combustion chamber according to the invention; and FIG. 2 shows in sideview the construction of a combustion chamber according to the present invention.

As explained above, generally, in the method according to the invention, a combustible gas, such as a combustible hydrocarbon, e.g. propane, and air or another oxygen containing gas which provides the oxygen needed for the combustion/explosion/detonation is introduced into a combustion chamber 1 having an essentially elongated shape with a first tapered and closed end 2 and a second tapered and open end 3, which is oppositely placed with respect to the first. The gas and the oxygen containing gas are fed into and mixed in an ignition zone 4, which is located in the vicinity of the first end of the chamber. The gas is ignited at a plurality of ignition points 5, which are symmetrically disposed with regard to the central axis of the chamber. When the gas is ignited it will create an explosion and an explosion wave, which will be reflected from the inner walls of the first end of the combustion chamber, thus forming a collision center (or "first compression zone"). In the collision center, a detonation will then be initiated in at least one part of the gas mixture.

According to a preferred embodiment, combustible gas and oxygen is fed into the combustion chamber 1, which has a generally elongated shape with two opposite ends 2, 3 to form a combustible gas mixture, the gas mixture is ignited for generating a pressure pulse, and the pressure pulse is released from the chamber and conducted to the amplifying horn 6 for creating amplified pulse, and the gas mixture is ignited in an ignition zone 10 located close to one end 2 of the combustion chamber to generate an initial explosion which causes a pressure wave, which is reflected from the inner walls of the chamber end to form a collision zone, in which the initial explosion is at least partially transformed into a detonation, whereat the gas mixture is ignited in the ignition zone by symmetrically placed ignition means 5.

According to a further embodiment, the combustion wave of the gas-air mixture burned in the combustion chamber 1 is self-compressed by colliding the combustion front, generated from symmetrically installed initiators 5, at a point essentially along the central axis of the chamber 1, by reflecting the combustion front from the gas and air inlet end 2 and by compressing the combustion front at the other end 3 of the chamber, from where the pressure is released to the amplifying horn 6.

The wave of flame front will travel along combustion chamber, which, as can be seen in the embodiment of FIG. 2, is constantly tapering towards the second (remote) end of the chamber, whereby more compression is achieved and flame speed is increased. In this kind of a combustion chamber, the gas fed into the chamber will burn completely within very short distance, in practice about less than 1000 mm, in particular less than about 600 mm.

Thus, as explained above, the combustion wave of the gas-air mixture burned in the combustion chamber will become self-compressed with three different methods at same time, viz. the combustion front, generated from symmetrically installed initiators 5, will collide at center, it will be reflected from round or parabolic or conical head at the gas and air inlet end and it will become compressed at the other conical end, wherefrom pressure is released to the amplifying horn 6.

The preferred embodiment of the invention, shown in FIG. 2, comprises a combustion chamber 1, wherein a round or parabolic or conical chamber head 2 will continue a short distance as a cylinder 7 and—at a distance apart from the cylindrical or almost cylindrical part—take up the shape of a gently sloping (truncated) cone 8 towards the second end of the chamber. A horn is fitted after this cone. The horn will increase the cone area by up to 20-30 times compared to the area at the interface between the combustion chamber and horn at the connection point. By "area" we mean the cross-section against the central axis of the chamber.

By a careful design of the combustion chamber 1, the pulsing frequency of the system can be improved. The limiting factor in shortening pulse intervals is typically the widening of the pulses, whereby two successive pulses can be merged. In such case, the cleaning efficiency of the pressure wave decreases, as the pulsing apparatus acts more like a continuous burner. The widening of the pulses is caused by the reflection of the pressure front back and forth in the chamber. Therefore, the chamber should be shaped so that no such undesired reflection areas exist in the chamber. In other words, the purpose of the shaping of the chamber is to channel the energy carried by the pressure front to the amplifying horn as quickly and directly as possible. The abovementioned conical or parabolic shape of the first end and sloping shape of the second end of the chamber has proven to provide up to 10-20 times shorter pulse exit times than an essentially flat bottom of the chamber. The earlier prototypes of the chamber enabled 1-2 ignition periods per second, while a chamber, which has been optimized in this respect can provide a pulsing frequency of up to 10-15 Hz, and even more.

Symmetrically installed spark plugs 5 are installed in the combustion chamber in the zone roughly at the part where the cylindrical part of the chamber starts.

Placing of the ignition means has a significant effect of the combustion process. In order to achieve maximum efficiency, shaping of the combustion chamber and placing of the spark plugs 5 are designed in close contact with each other. For example, if the first end of the chamber is parabolic-shaped, the plugs are preferably placed near the acoustic focus of the parabola. Thus, the pressure front emerging from the ignition zone is focused to the amplifying horn as directly as possible, providing shorter pulses of greater sound pressure. The number of spark plugs can vary, for example, between 1 and 8, being typically 3 or 4.

It is well known that, in the expansion area of the horns, pressure will be transformed to greater amplitude, which phenomenon actually corresponds to the term "amplified". At the same time, in combustion chambers having a gently sloping cone or tapered end, such as the present, the pressure will increase in that end. Burning velocity is a function of temperature and pressure. When pressure increases, temperature will increase and reaction speed will increase progressively.

According to one embodiment, the amplifying horn 6 lies essentially on the longitudinal axis of the combustion chamber in its whole length. In another embodiment, the amplifying horn 6 is curved, whereby the apparatus can be fitted in more narrow spaces.

Another feature, which has aided in improving and increasing the burning velocity comprises a simple mixing arrangement, wherein gas is introduced from two or multiple pipes 9 to the mixing chamber, all tubes having slanting heads so that air flow will become highly turbulent at the head. The mixing zone 10 of the combustion chamber exhibits a plurality of gas feed nozzles for the combustible gas and at least one air feed nozzle for oxygen-containing gas. As will be discussed below, the gas feed nozzles 9 are preferably controlled by magnetic valves 11.

According to one embodiment, the mixing zone 10 is provided with mixing means. The mixing means can comprise an object or a plurality of objects of regular or irregular form mounted inside the mixing zone 10, thus assisting the mixing of the gases by bringing them into turbulent motion. The mixing means can, for example, be a spring-like instrument.

Surprisingly, it was further found that when air flows constantly to the combustion chamber, so that when explosion happens the air flow will simply be compressed backwards, after the combustion this pressure and constant drive pressure of air will rinse the chamber clean from combustion gases and provide new fresh air to a second combustion.

The oxygen-containing gas can also be pure or essentially pure oxygen. By using pure oxygen, the burning process can further be intensified. The feed of the oxygen containing gas to the mixing zone 10 can be controlled by magnetic valves.

According to a preferred embodiment of the invention, a great number of explosions are created in the combustion chamber per time unit. In order to have the gas and air in the apparatus explode at higher frequency there is a need for specific kinds of gas valves, which also operate at high frequency. Small valves operate normally at higher frequency than bigger valves, and for this reason there are used up to six small valves to provide for parallel feed of gas through a plurality of gas tubes. Air can be fed separately from the gas and through one single air feed tube 12 (see FIG. 1A). In some preferred embodiments, the air tube has a length before bigger local resistance which is at least two times as long as the combustion chamber.

During operation, for providing, say, explosions at 10 Hz, the air valve is constantly open, whereas the gas valves are operated in such a way that they open and close 10 times per second and they are open during a time interval of from 10 to 50 ms. When the gas valves are closed, the ignition plugs are fired. With this kind of operation mode, it is possible continuously to produce gas pressure pulses with the present apparatus during extended periods of time, typically about 1-3 seconds. Between active operation modes, the combustion chamber is allowed to cool. During the cooling phase airflow can be maintained constant until sufficient cooling has been achieved.

In a typical application, the system is used to provide acoustic pulses at 10-20 Hz. The pulses can be generated in sets having a length of, for example, 0.5-5 seconds and repeating, for example, every 0.5-3 minutes, depending on the type of target to be cleaned. A single burst can have a duration of 0.1 to 5 ms, typically around 1 ms. During this time, the ignition means can be fired, for example, at a rate of 1-100 sparks/ms, typically 40-50 sparks/ms.

From acoustic theory, it is known that different bodies coupled together will change the acoustic impedance and this way the total performance of acoustic behavior of the total installation. As far as this feature is concerned, the dimensions of the combustion chamber and the dimensions of the horn are important. The optimum acoustic configuration is very difficult to calculate or near impossible to do it by only mathematical means.

The ignition means are preferably controlled by an ignition unit. According to one embodiment, the ignition unit comprises an ignition coil having a plurality of outputs to the ignition means. The ignition coil can, in principle, resemble ignition coils used in vehicles to ignite combustion engines. However, the ignition coil is arranged to ignite every connected spark plug essentially simultaneously for ensuring precipitous explosion of the gas mixture. By this igniter arrangement, the spark rise time can be decreased to provide for sparkling frequency of, for example, 20-60, and typically 40-50 full sparks/ms, of each of the spark plugs 5. Furthermore, ignition pulse frequencies in a typical range of operation, 0.1-30 Hz, for example, can be achieved.

According to one embodiment, the ignition coil is controlled by a driver unit, which comprises an ignition driver and a coil drive unit. The ignition driver receives the ignition trigger signals and outputs ignition signals to the coil drive unit. The coil drive unit feeds the ignition coil.

The apparatus and its embodiments discussed above can be used for cleaning soot- or particle-laden surfaces of processing equipment for removing dust deposits from the surfaces of the processing equipment. Such a method thus comprises using an apparatus having a combustion chamber two opposite ends, the first end allowing for the feed of a combustible gas mixture and the second end allowing for the discharge of a gas pulse generated by combustion of the gas mixture. An amplifying horn is connected to the discharge end of the combustion chamber exhibiting an ignition zone, a reflection zone, and a compression zone, the zones having for example the properties discusses above. The apparatus or a plurality of such apparatuses can be provided in the vicinity of the processing equipment for directing the pressure waves towards the object subjected to cleaning. The apparatus can, for example, be mounted on a wall of the processing space.

EXAMPLE

A combustion chamber having the configuration shown in FIG. 2 has a length of 560 mm, a diameter at cylindrical part of 168 mm and a minimum diameter of 66 mm at the point where the horn started to open. Spark plugs (3) are located 84 mm from the round end (FIG. 1C) symmetrically positioned along the periphery of the chamber at 120 degrees from each other. The horn had a total length of 1340 mm and it was provided with two different cones, the first one 40 mm-250 mm, the second one 250-350 mm.

The combustible gas (drive gas) used was propane, which was mixed with air, and at a 10 Hz operational frequency we obtained a 170 dB sound level, by burning only about 370 mg propane per explosion.

By contrast, during earlier experiments with a different combustion chamber having an elongated, by essentially throughout cylindrical shape, we burned 2000 mg propane per explosion to get the same sound pressure level as with the equipment represented in this invention. In addition to the great saving in fuel consumption, with the present invention the further important advantage—when considering that it is intended for cleaning of dust deposits—is the speed of positive pressure swing to negative pressure. This is optimally achieved if the burning of gas mixture is as rapid as possible. With the present apparatus configuration this can be achieved.

The gas and air is mixed before the combustion chamber in smaller mixing zone of the combustion chamber, where gas is injected from two pipes in the center of the air flow (cf. FIG. 1B). In one embodiment, the combustion chamber had the following configuration: A first conical part with a length of 65 mm, then a cylindrical part with spark plugs, total length 40 mm, further a slight cone of 106 mm, then a cylindrical part some 40 mm long and the in the remote section of the chamber a reverse slight cone (106 mm), a cylindrical part (40 mm), a conical part (65 mm) long, where the cone ends were 115-56 mm, so the total combustion chamber was symmetrically widened and symmetrically contracted.

The following is needed for achieving at least in one part of the combustion a real detonation: Symmetrical ignition which causes a first compression when the pressure waves will collide, an end providing focused reflection (achieved with a round, parabolic or conical bottom), said end being the one into which the gases are fed. And finally, and advantageously, a funnel-like part before the pressure wave gases are released to the amplifying horn. At least in this section of the apparatus, where pressure will speedily increase when the waves enter the increasingly narrowing part of the tube, detonation will be initiated. Possibly, not all of the gas will detonate, but probably at least some 10 volume % (e.g. 0.2-0.3 part) of gas-air mixture will detonate, whereas the remaining part of the mixture will explode and provide for the necessary compression for detonation.

A sufficient length of the air tube or manifold before the open valve between said valve and combustion chamber is advantageous for air purging subsequently to the pulse.

When the equipment explosions are oscillating 10 times per s, we have found that the best resonance effect is obtained with a configuration, where a 560 mm long combustion chamber and a 1340 mm long horn are installed together. In this assemble the best resonance and best sound pressure levels seem to be obtained. FIG. 2 shows the structure of the combustion chamber according to one exemplifying embodiment.

As earlier mentioned, the small multiple parallel magnetic valves can be adjusted to operate for example at a frequency of 0.1-30 Hz, and the same can be made easily for the igniter. Because the operation can be electronically guided, we can make series of pulses, where frequency, $f_n = f_{n-1} + \Delta f$ or $+ \rightarrow -$.

This means that the pressure pulse series can be variably programmed. Because the best pulse frequency of a new power plant, in which the pulse cleaner is to be assembled, is not necessarily known beforehand, the equipment according to the present invention can programmed to perform different programs. It is very probable that at certain pulse frequency, even if the horns basic frequency is constant, we can perform optimum cleaning. This is due to the fact that all deposits must have some kind of critical breaking down frequency, where cleaning is most easy.

The invention claimed is:

1. A method of producing gas pressure pulses in a dust-deposit cleaning apparatus for cleaning dust deposits of a processing equipment, the method comprising:

providing apparatus including a combustion chamber and an amplifying horn, wherein the combustion chamber has an elongated shape with first and second opposite end regions that terminate at first and second ends respectively of the combustion chamber, the first and second end regions taper toward the first and second ends respectively, and the amplifying horn is located at the second end of the combustion chamber, feeding a combustible gas and oxygen into the combustion chamber via at least one inlet at the first end of the combustion chamber to form a combustible gas mixture, igniting the gas mixture for generating a pressure pulse by symmetrically placed ignition means in an ignition zone in the first end region of the combustion chamber and spaced from the first end of the combustion chamber to generate an initial explosion which causes a pressure wave, which is reflected from the inner walls of the combustion chamber in the first end region to form a collision zone, in which the initial explosion is at least partially transformed into a detonation, and releasing the pressure pulse from the combustion chamber via an outlet at the second end of the combustion chamber and conducting the pressure pulse to the amplifying horn for creating an amplified pulse to impinge on the processing equipment to be cleaned, and wherein a combustion front generated by symmetric ignition of the combustible gas mixture is self-compressed by colliding at a point essentially along the central axis of the combustion chamber, and is compressed by reflection from the tapered first end region of the combustion chamber between the ignition zone and the first end of the combustion chamber, and the the combustion front is compressed by entering a compression zone formed by the taper of the second end region of the chamber.

2. The method according to claim 1, comprising controlling feed of gas into the combustion chamber by magnetic valves to provide for a plurality of simultaneous gas feed flows into the chamber.

3. The method according to claim 1, comprising feeding air constantly into the combustion chamber during operation.

4. The method according to claim 1, comprising generating a series of gas phase pressure pulses and varying the frequency of the pulses.

5. The method according to claim 1, wherein the ignition zone is of substantially uniform diameter.

6. The method according to claim 1, wherein the ignition means comprises a plurality of spark plugs.

7. The method according to claim 1, comprising a mixing chamber at the first end of the combustion chamber, the mixing chamber having a plurality of inputs for introducing fuel and at least one input for introducing air.

8. Dust-deposit cleaning apparatus, comprising in combination:

a combustion chamber having an elongated shape with first and second opposite end regions that terminate at first and second ends respectively of the combustion chamber and taper toward the first and second ends respectively, at least one inlet at the first end for feeding a combustible gas mixture into the combustion chamber, an outlet at the second end for discharging a gas pulse generated by combustion of the gas mixture, and an ignition zone in the first end region and spaced from the first end, ignition means in the ignition zone of the combustion chamber, the ignition means being symmetrically placed about the combustion chamber, and an amplifying horn connected to the second end of the combustion chamber, and wherein the tapered first end region of the combustion chamber forms a reflection zone at the first end region of the combustion chamber for focused reflection of gas pressure waves generated by ignition of the combustible gas mixture, and the tapered second end of the combustion chamber forms a compression zone at the second end region of the combustion chamber to compress the gas waves being discharged via the amplifying horn.

9. The apparatus according to claim 8, wherein the combustion chamber has a mixing zone provided with a plurality of gas feed nozzles for the combustible gas and at least one feed nozzle for oxygen-containing gas, said gas feed nozzles being controlled by magnetic valves.

10. The apparatus according to claim 8, comprising an ignition coil and an ignition coil driver unit for controlling the symmetrically placed ignition means.

11. The apparatus according to claim 8, wherein the ignition zone is of substantially uniform diameter.

12. The apparatus according to claim 8, wherein the ignition means comprises a plurality of spark plugs.

13. The apparatus according to claim 8, comprising a mixing chamber at the first end of the combustion chamber, the mixing chamber having a plurality of inputs for introducing fuel and at least one input for introducing air.

14. A method of cleaning a soot-laden or particle-laden surface of processing equipment, the method including using acoustic energy generated by apparatus comprising, in combination:

a combustion chamber having an elongated shape with first and second opposite end regions that terminate at first and second ends respectively of the combustion chamber and taper toward the first and second ends respectively, at least one inlet at the first end for feeding a combustible gas mixture into the combustion chamber, an outlet at the second end for discharging a gas pulse generated by combustion of the gas mixture, and an ignition zone in the first end region and spaced from the first end, ignition means in the ignition zone of the combustion chamber, the ignition means being symmetrically placed about the combustion chamber, and an amplifying horn connected to the second end of the combustion chamber, and wherein the tapered first end region of the combustion chamber forms a reflection zone at the first end region of the combustion chamber for focused reflection of gas pressure waves generated by ignition of the combustible gas mixture, and the tapered second end region of the combustion chamber forms a compression zone at the second end region of the combustion chamber to compress the gas waves being discharged via the amplifying horn.

15. The method according to claim 14, wherein the ignition zone is of substantially uniform diameter.

16. The method according to claim 14, wherein the ignition means comprises a plurality of spark plugs.

17. The method according to claim 14, comprising a mixing chamber at the first end of the combustion chamber, the mixing chamber having a plurality of inputs for introducing fuel and at least one input for introducing air.

* * * * *